United States Patent [19]

Velke, Sr. et al.

[11] Patent Number: 4,842,535

[45] Date of Patent: Jun. 27, 1989

[54] GAS TUBE ELECTRODE CONNECTOR

[76] Inventors: David C. Velke, Sr., 3305 Aldie Rd., Catharpin, Va. 22018; George P. Marsden, 7621 Mary Cassatt Dr., Potomac, Md. 20854; Burton C. Leffingwell, 242 Meadows La. NE., Leesburg, Va. 22075

[21] Appl. No.: 212,586

[22] Filed: Jun. 28, 1988

[51] Int. Cl.[4] ..... H01R 33/02

[52] U.S. Cl. ..... 439/232; 439/226; 439/228; 439/243; 313/51; 362/217; 248/50

[58] Field of Search ..... 439/226–235, 439/242–244; 313/51, 567, 582, 583; 362/217, 225; 248/50; 40/545

[56] References Cited

U.S. PATENT DOCUMENTS

| | | | |
|---|---|---|---|
| 1,878,229 | 9/1932 | Beck | 439/230 |
| 1,896,365 | 2/1933 | McClelland | 439/230 |
| 4,444,446 | 4/1984 | Hageman | 439/230 |

*Primary Examiner*—Eugene F. Desmond

*Assistant Examiner*—Stephen A. Zagrobelny

*Attorney, Agent, or Firm*—Richard C. Litman

[57] ABSTRACT

A connector for discharge electrodes of luminous gas tubes includes an insulative barrel receiving a power cable at one end for attachment to a fixed end of a resilient contact member. The opposite end of the barrel is open and threaded, to receive the crimped and headed tip of a gas tube having electrode conductors projecting therefrom. A lock element is applied to the crimped portion of the gas tube end and is axially captured thereon so that following insertion of the tube tip and lock element into the barrel open end, a cap surrounding the gas tube engages the threads of the barrel to radially and axially retain the tube tip within the barrel interior with its electrode conductors firmly biased against a displaceable end of the resilient contact member. In an alternate embodiment, the same lock element serves to secure each of a pair of gas tube tips within a housing having a contact member provided with displaceable end segments serving to electrically join the electrode conductors of the pairs of gas tubes.

16 Claims, 2 Drawing Sheets

GAS TUBE ELECTRODE CONNECTOR

BACKGROUND OF THE INVENTION

This invention relates generally, to electrical connectors and more particularly, to an improved connector assembly especially adapted to provide a positive structural as well as electrical connection between high voltage cables and electrode containing tips of luminous gas tubes.

Numerous examples exist of attempts to provide convenient means for physically and electrically joining the ends of gaseous discharge tubes either serially to one another or to the high voltage supply lines providing the power to the tubes. In the illuminating sign field, such as neon signs, glass tubes are shaped as desired, evacuated, and then filled with a measured amount of neon or other gas and then sealed. Illumination of the gas is attained by applying current to electrodes, mounted within the ends of the glass tubes and having their wire conductors projecting from the sealed tube ends.

Several shortcomings are exhibited by the connecting mechanisms which have long been employed to attach the power cables to these tube electrodes. First, in the interest of facilitating attachment of such connectors, which must be applied under less than ideal situations, usually on the face of an elevated wall, many connectors lack a positive, rigid interfitting relationship with the associated tube end. Secondly, a problem still prevails from the standpoint of maintaining an arc-free juncture between the electrode conductors and the power cable conductor. This will be all the more appreciated when it is understood that voltages of 7,500 to 15,000 v. are involved and many installations remain fully exposed to the elements.

DESCRIPTION OF THE RELATED ART

Several prior art devices have been developed in attempts to provide means for connecting power cables to the discharge electrodes of luminous gas tubes and or serially joining such tubes. U.S. Pat. No. 1,920,555 issued Aug. 1, 1933 to Grbovic, proposed a juncture between adjacent tube units comprising solely a coiled end of each electrode conductor, projecting from the sealed end of the tubes and which merely abuts a similar member from an adjacent tube electrode. U.S. Pat. No. 2,011,178 issued Aug. 3, 1935 to Komm et al, and U.S. Pat. Nos. 4,444,446 dated Apr. 24, 1984 and 4,460,226 issued July 17, 1984, both to Hageman, teach examples of gas tube electrode tip connectors comprising a tubular housing for receiving the gas tube tip and containing a coiled spring extension of the power cable conductor, which is compressed upon insertion of the tube tip into the housing. In none of the above prior art examples is found the concept advanced by the present invention wherein, positive stabilizing means insure radial and axial fixation of a gas tube end relative a connector assembly which also offers an enhanced weather-resistant electrical juncture between a power line conductor and discharge electrode conductor, with minimal chances of arcing therebetween.

SUMMARY OF THE INVENTION

By the present invention, an improved connector assembly is provided which readily accomplishes a positive mechanical and electrical connection between a discharge electrode in the end of a gas tube, and either the conductor of a power cable or the discharge electrode of an adjacent gas tube. Included, is an insulative barrel having threads at both ends and having a resilient, compressible contact member therein with means at one end providing angular stability and attachment of a power cable thereto. An electrode containing gas tube end having a crimped end including an enlarged distal portion, is insertable within the other end of the barrel and is radially stabilized therewithin by means of a lock member having a radial throat adapted to captively engage the crimped portion of the tube end while the periphery of the lock member provides a close fit within the barrel.

As the above components are axially assembled, electrode conductors extending from the gas tube tip, are urged into engagement with the forward contact segment of a resilient contact member, thereby axially compressing same following which, a threaded cap closely surrounding the gas tube tip is manipulated to lock with the threads on one end of the barrel. Weather and electrical shielding is provided by the application of a threaded metal shield about the barrel and a water seal member about the tube tip and barrel-attached cap.

Accordingly, one of the objects of the present invention is to provide an improved electrical connector for luminous gas tubes and which provides both an enhanced electrical and structural connection.

Another object of the present invention is to provide an improved electrical connector for gas tubes having a crimped portion adjacent a headed distal tip and which includes a housing having a segmented contact member with one end stabilized within the housing and the opposite end dished to accept conductors projecting from the tip of the gas tube and wherein a removable lock element mounted on the tube crimped portion is captively retained within the housing by a cap threadedly applied to the housing.

A further object of the present invention is to provide an improved electrical connector including a housing having dual threaded bores closely receiving a pair of gas tube tips with electrode conductors projecting therefrom and including lock elements removably applied to the tube tips serving, along with threaded caps, to captively secure the tubes with the conductors biased into engagement with a common resilient contact member within the housing.

With these and other objects in view which will more readily appear as the nature of the invention is better understood, the invention consists in the novel construction, combination and arrangement of parts hereinafter more fully described, illustrated and claimed.

Preferred and practical embodiments of the invention are shown in the accompanying drawings, in which:

BRIEF DESCRIPTION OF THE DRAWINGS

Similar reference characters designate corresponding elements throughout the several figures of the drawings.

DETAILED DESCRIPTION OF THE PREFERRED EMBODIMENTS

Figure 1:
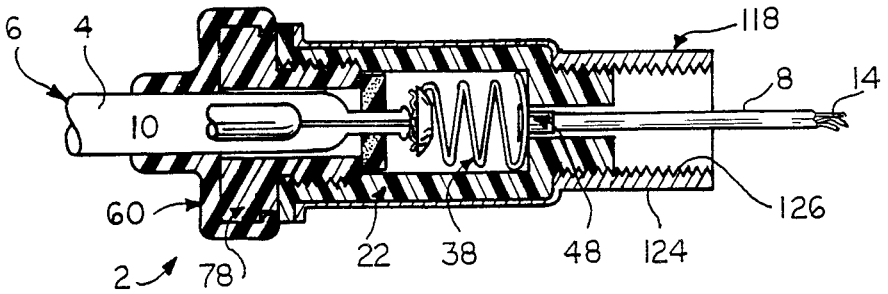
FIG. 1 is a longitudinal view, partly in section, of the present connector as it appears when assembled.
Figure 2:
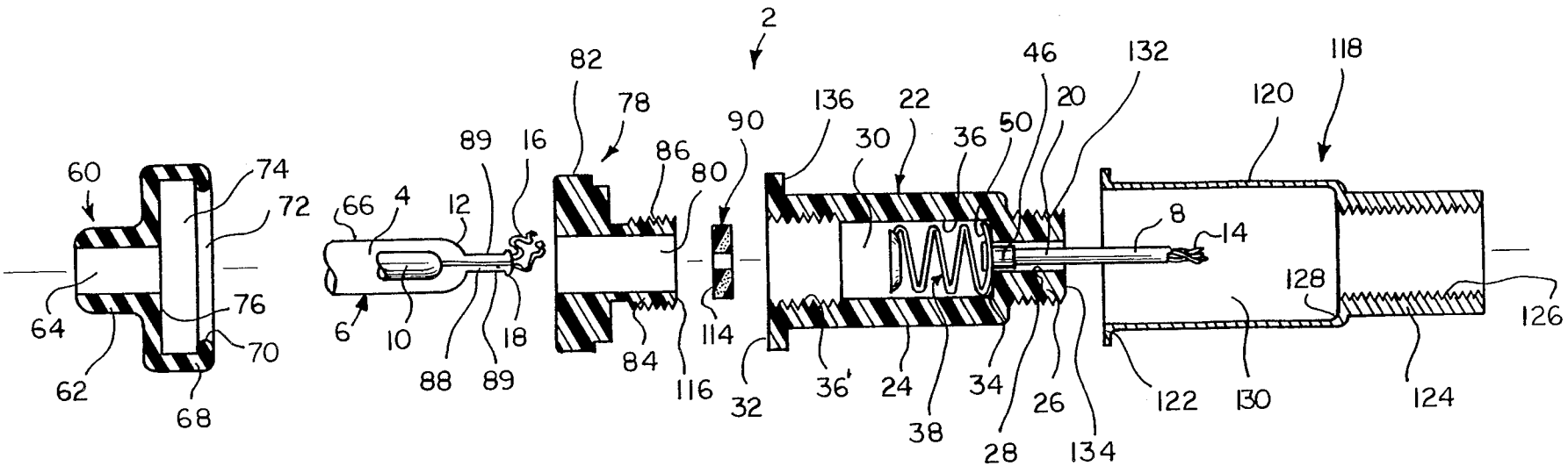
FIG. 2 is an exploded view of the components shown in FIG. 1.

Referring now to the drawings, particularly FIGS. 1 and 2, the present invention will be seen to comprise a connector, generally designated 2, and which serves to mechanically and electrically join the electrode end 4 of a gas tube 6 with a power cable or line 8. Inasmuch as the connector 2 is primarily intended for use in the luminous sign industry, it will be understood that the gas tubes 6 will comprise well known glass tubing which has been shaped, evacuated and then filled with a prescribed amount of gas, such as neon, prior to being sealed. Such tubes provide their illumination upon the application of an electrical charge to discharge electrodes 10 placed within the tubes adjacent their end walls 12. Energizing of these electrodes 10 is accomplished by suitably attaching the conductor 14 of the power line 8 to conductors 16 projecting from the distal tip 18 of the gas tube 6.

By the present construction, an improved electrical connection is assured such that arcing is minimized or precluded altogether. It will be appreciated that the power line or cable 8 is supplied from a transformer (not shown) as is well known in this art and delivers current at voltages between 3000–15,000 volts through its conductor 14. This cable is commonly known as GTO cable and will be understood to have its conductor 14 bared at its end 20 for attachment to the connector 2.

The connector 2 includes an elongated housing or barrel 22 preferably having a cylindrical periphery 24 and which terminates in a reduced diameter, rear end portion 26 having external threads thereon. A central bore 28 extends through the otherwise solid rear end portion 26 and is of a diameter permitting of insertion of the power cable 8. An enlarged, central cavity 30 extends rearwardly from the forward, end face 32 of the barrel 22 and terminates at the cavity end wall 34. Internal threads 36′ will be seen to be formed in the inner wall 36 of the cavity, adjacent to the barrel end face 32, for reasons which will become apparent hereinafter.

Electrical communication between the power line 8 and an inserted gas tube end 4, is provided by a resilient, compressible, high voltage contact member, generally designated 38. The details of construction of a preferred contact member are shown most clearly in FIGS. 3 and 4 of the drawings. This member is preferably formed from a flat strip of spring brass and will be seen to include a rear, anchor segment 40 cut to provide a rectangular element having a plurality of sharp corners or points 42 with the diagonal between two opposed such points preferably no less than the diameter of the cavity 30. A central hole 44 in the segment 40 is adapted to receive, in a close fit, the shank 46 of a grommet 48 having a radially extending head 50. The central body 52 of the contact member 38 is shown as comprising an elongated portion tapering from the anchor segment 40 to an endmost, forward contact segment 54 the latter of which is dished or cup-shaped and includes a central bore 56.

Figure 3:
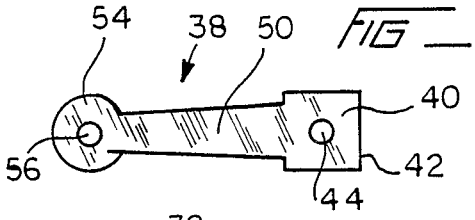
FIG. 3 is a plan view of the contact member as it appears prior to formation into its use position.
Figure 4:
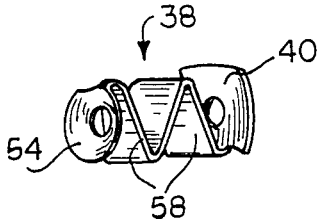
FIG. 4 is a perspective view of the formed contact member.
Figure 7:
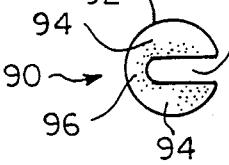

The above described contact member as shown in FIG. 3 is formed into the use configuration of FIG. 4 by bending the central portion 52 in a zig-zag manner so as to provide a plurality of spaced apart intermediate segments 58 joining the rear and forward segments 40 and 54.

The connector is readied for use by inserting the bared end conductor of the power cable 8 through the bore 28 of the barrel 22 and thence crimping, soldering or otherwise affixing, the conductor 20 within the shank 46 of the grommet 48 which has been inserted through the rear contact member hole 44. Then, the cable 8 and its attached contact member 28 are pulled rearwardly to the use position as shown in FIGS. 1 and 2 whereupon, the rear, anchor segment 40 will abut the end wall 34 of the barrel cavity 30, with the points 42 frictionally engaging the periphery of the cavity. The thus prepared connector is then ready to be attached to a gas tube end 4. Prior to this union, a seal member 60 having a reduced diameter rear sleeve 62 provided with a bore 64, is slipped over the gas tube periphery 66. This seal member 60 is constructed of resilient material such as synthetic rubber and the bore 64 will be understood to provide a tight sliding fit about the gas tube periphery 66. Attached to the seal rear sleeve 62 is a forward, enlarged diameter sleeve 68 which will be seen to provide an inturned lip 70 defining a forward opening 72 leading to an internal cavity 74. This cavity extends rearwardly to the rear wall 76 containing the bore 64.

Another element is then slipped over the gas tube end 4 and comprises a lock cap 78 having a central bore 80 presenting a close sliding fit relative the tube periphery 66. The exterior of this cap 78 includes a rear, enlarged, knurled flange 82 joined to a forward, reduced diameter shank 84 having external threads 86 thereon adapted to mate with the threads 36′ within the forward end of the barrel 22.

Figure 5:
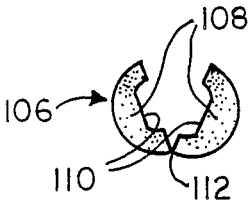
FIG. 5 is a plan view of one form of lock member.
Figure 6:
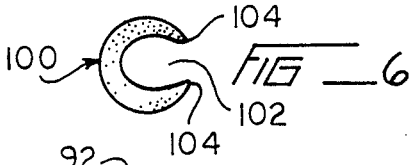
FIGS. 6 and 7 are plan views of alternate forms of lock members.

Completion of the pre-assembly procedure involves the application of a lock element, such as shown in FIGS. 5≧7, to the forward portion of the tube end 4. As shown, this lock element may comprise various configurations, all of which are generally C-shaped and define an open throat extending through and past the center of a circular, disc like dielectric member. In each lock element embodiment, the throat will be understood to provide a close fit about the flattened, crimped portion 88 extending beyond the end wall 12 of the gas tube 4. In the embodiment of FIGS. 1,2 and 5, lock element 90 will be seen to include a circular periphery 92 as defined by two segments 94—94 connected by an integral web 96 and presenting the straight-walled throat 98 therebetween. The lock element 100 shown in FIG. 6 differs in that the throat 102 is thicker or wider and the tips 104 of the two segments are slightly inturned to enhance the clamping action of the throat when slipped over a gas tube crimped portion 88. The remaining lock element 106 of FIG. 5 comprises two semi-circular segments 108—108 each having an intermediate cut-out 110 therein and which are joined together such as by a live hinge 112.

The lock elements are constructed of fibrous or other suitable insulative material possessing dimensional stability and are utilized by slipping the selected lock element 90,100 or 112 over the two flat surfaces 89—89 of the tube crimped portion 88. It will be appreciated that the width of the throat of the lock element is selected so as to provide a close, firm fit with the segments of the lock element fully containing the tube crimped portion 88. As shown most clearly in FIG. 1, the installed lock element 90 is axially captively retained between the tube end wall 12 and the enlarged construction of the head or distal tip 18 of the tube.

The thus described components are assembled by axially inserting the tube tip 18 into the barrel cavity 30 and continuing this movement until the tube tip engages and then axially compresses the resilient contact member 28 to the position shown in FIG. 1 of the drawings. When thusly disposed, it will be seen that the conductors 16 of the discharge electrode 10 are firmly engaged within the dished, forward contact segment 54 and will remain in positive contact therewith in view of the compressed state of the intermediate segments 58 of the contact member 28.

Following the above assembly, the cap 78 is axially advanced toward the barrel 22 and twisted to fully engage the mating threads 36',86. The seal member 60 is then forced to overlie the cap 78 to provide a weather-resistant arrangement. As thusly assembled, the gas tube end 4 will be seen to be both electrically and structurally mounted with respect to the contact member 28 and the source of high voltage current as provided by the cable 8. Radial displacement of the gas tube end 4 is restricted in view of the close fit between the periphery of the lock element 90 and the juxtaposed inner wall 36 of the barrel cavity 30 while, axial stability is provided in view of the captive mounting of the lock element upon the crimped portion 88 and the constant abutment of the rear face 114 of the lock element with the forward shoulder 116 of the cap shank 84. This latter abutment is assured as the inner diameter of the cap bore 80 is less than the outer diameter of the lock element 90.

The assembly of the connector 2 is completed by the application of a tubular metal shield 118 over the barrel 22. This shield includes a main body 120 terminating at its forward end in an outer flange 122 while the opposite rear end of the sleeve is provided with a reduced diameter neck portion 124 having internal threads 126 terminating in a forwardly facing shoulder 128. Upon slipping the shield cavity 130 over the barrel 22, the shield threads 126 engage the barrel threads 132 formed on the barrel end portion 26 until the shoulder 128 abuts a rearwardly facing shoulder 134 on the barrel. At this same point, it will be seen from FIG. 1 that the shield flange 122 will about the radial flange 136 provided at the forward end of the barrel such that the barrel will be substantially fully protected. As will be seen in FIG. 1, the assembled shield presents a substantial portion of remaining, unused threads 126 within the neck portion 124 and which may be used for the application of any well known cable connector to further stabilize the attachment of the power cable 8 relative the connector 2.

The above described connector 2 may be used for the ends of any gas tube 6 such as used in the luminous sign industry, with the location of the subject connector being determined by the type of sign involved and the configuration thereof. For example, in some installations, sign letters are formed by gas tubes mounted by well known stand-off devices to a base or wall while at other times the lettering further comprises one or more shaped gas tubes mounted within a plurality of shadow boxes or peripheral frames. Depending upon the specific environment, the present connectors may be freely attached to the respective gas tube ends 4, even if disposed through openings in shadow frames or attached through openings provided in a back wall.

Figure 8:
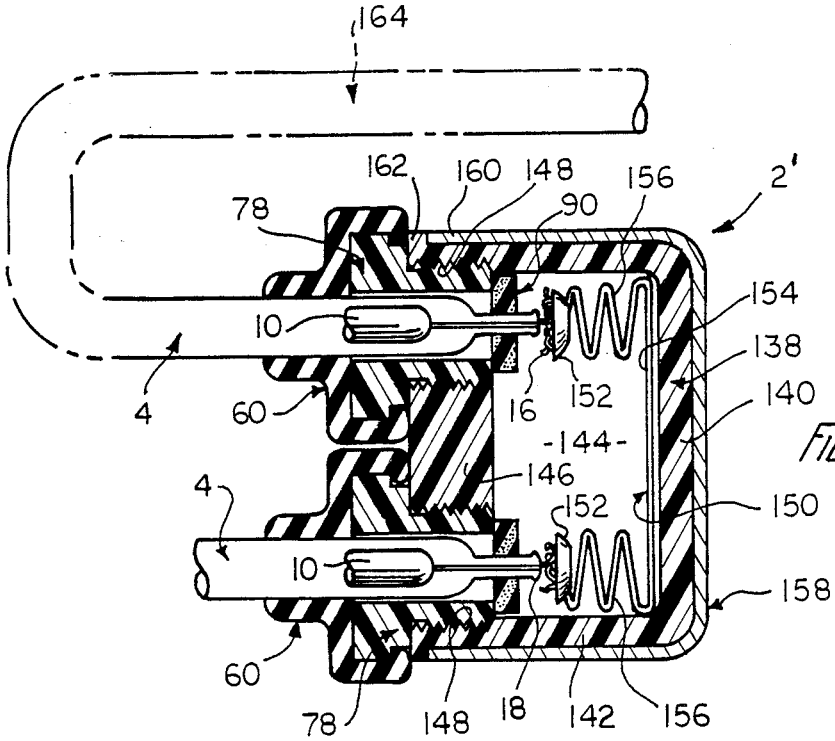
FIG. 8 is a side elevation, partly in section, of an alternate embodiment of the invention.

In many instances, it is desired to electrically attach the gas tube ends 4 of two adjacent, parallel or in-line tubes. An alternate connector 2' is shown in FIG. 8 for accomplishing this attachment and includes a housing 138 having a bottom or end wall 140 joined to a side wall 142 and forming a cavity 144 therebetween. The opposite end of the housing is provided with a front wall 146 having two adjacent threaded bores 148—148 therethrough adapted respectively, to receive a gas tube end 4 and cap 78 as described with respect to the connector 2. However, in this latter instance, a single compressible contact member 150 is provided having two dished forward contact segments 152,152 joined to a common base segment 154 by means of the resilient, intermediate segments 156. The assembly of the connector 2' is completed by the application of the same lock elements as used in the first described embodiment, along with a metal shield 158 until its forward edge 160 abuts the radial flange 162 on the housing 138.

The connector 2' may be employed in joining two adjacent, parallel gas tube ends 4,4 as shown in full lines in FIG. 8 of the drawings or alternatively, to join two substantially in-line tubes such as reflected by the lowermost tube end 4 and the return bend tube end 164 shown in broken lines in this figure.

We claim:

1. In an electrical connector for joining a first wire conductor to a second conductor as formed by one or more electrode wires projecting from the headed tip of a luminous gas tube and wherein the gas tube includes a cylindrical main body joined to a reduced dimension crimped portion terminating in the headed tip, comprising:

a housing of dielectric material having first and second bores therein communicating with a cavity, threads surrounding at least said second bore, a cap having threads mating with said second bore threads and having an axial bore adapted to closely surround the gas tube main body, an axially compressible resilient contact member within said housing cavity having opposite end segments respectively engageable with the first and second conductors, a lock element removably attachable about the gas tube crimped portion intermediate the tube main body and headed tip, said lock element having a lateral dimension greater than the diameter of the gas tube main body and said bore of said cap, whereby, with said cap disposed about the gas tube main body and said lock element then attached about the gas tube crimped portion the tube headed tip is insertable within one said housing bore with the second conductor projecting therefrom engageable with one said contact member end segment to complete a circuit through the other said contact member end segment following which said cap threads are engaged with said housing second bore threads to urge said lock element to maintain said second conductor in positive abutment with said one contact member segment.

2. An electrical connector according to claim 1 wherein, said lock element comprises a dielectric member.

3. An electrical connector according to claim 1 wherein, said lock element defines a substantially C-shaped member.

4. An electrical connector according to claim 1 wherein, said contact member comprises a unitary element of conductive strip material.

5. An electrical connector according to claim 1 wherein, said housing comprises an elongated barrel having a rear end provided with said first bore and including an end wall facing said second bore, and said contact member end segments including a rear anchor segment abutting said end wall and a forward contact segment constantly spring-urged toward said second bore.

6. An electrical connector according to claim 1 including, threads on said housing adjacent said first bore, a metal shield having an interior conforming substantially to the external configuration of said housing, and threads on said shield engageable with said housing threads adjacent said first bore as said shield is applied about said housing.

7. An electrical connector according to claim 1 including, a seal member of resilient composition having a central bore joined to an enlarged cavity, said seal member bore providing a friction fit about the gas tube main body, and said seal member cavity adapted to engage closely a substantial portion of said cap.

8. An electrical connector according to claim 1 wherein, said lock element includes a pair of arcuate segments joined by a web at one end thereof and defining an elongated throat therebetween extending through the center of said lock element.

9. An electrical connector according to claim 1 wherein, said lock element includes a substantially circular external periphery.

10. An electrical connector according to claim 1 wherein, said housing bores are axially aligned with one another.

11. An electrical connector according to claim 1 wherein, said housing bores are parallel and adjacent one another.

12. An electrical connector according to claim 4 wherein, said contact member includes a plurality of intermediate segments between said opposite end segments.

13. An electrical connector according to claim 5 wherein, said contact member defines a zig-zag configuration between said end segments.

14. An electrical connector according to claim 5 wherein, said rear anchor segment is polygonal and the corners thereof frictionally engage the wall of said cavity adjacent said end wall.

15. An electrical connector according to claim 5 wherein, said contact member comprises a strip element laterally tapered inwardly from said rear anchor segment to said forward contact segment.

16. An electrical connector according to claim 5 wherein, said forward contact segment is dished inwardly toward said rear anchor segment.

* * * * *